US011535948B1

(12) United States Patent
Fuschetti

(10) Patent No.: US 11,535,948 B1
(45) Date of Patent: Dec. 27, 2022

(54) ASSEMBLIES AND METHODS FOR ANODIZING A WORKPIECE SELECTIVELY USING A COMBINATION OF A MECHANICAL MASK AND A GAS BUBBLE OR AIR POCKET MASK

(71) Applicant: Michael Fuschetti, Rumson, NJ (US)

(72) Inventor: Michael Fuschetti, Rumson, NJ (US)

( * ) Notice: Subject to any disclaimer, the term of this patent is extended or adjusted under 35 U.S.C. 154(b) by 0 days.

(21) Appl. No.: 17/587,722

(22) Filed: Jan. 28, 2022

(51) Int. Cl.

| | |
|---|---|
| ***C25D 11/02*** | (2006.01) |
| ***C25D 11/04*** | (2006.01) |
| ***C25D 17/08*** | (2006.01) |
| ***C25D 11/26*** | (2006.01) |
| ***C25D 17/00*** | (2006.01) |
| ***C25D 11/30*** | (2006.01) |

(52) U.S. Cl.
CPC ..... *C25D 11/022* (2013.01); *C25D 11/04* (2013.01); *C25D 11/26* (2013.01); *C25D 11/30* (2013.01); *C25D 17/004* (2013.01); *C25D 17/08* (2013.01)

(58) Field of Classification Search
None
See application file for complete search history.

(56) References Cited

FOREIGN PATENT DOCUMENTS

| | | | | |
|---|---|---|---|---|
| CN | 103160901 | * 12/2011 | ..... | C25D 11/02 |
| CN | 113748232 | * 12/2021 | ..... | C25D 11/00 |
| WO | WO2018173719 | * 9/2018 | ..... | C25D 11/02 |

* cited by examiner

*Primary Examiner* — Stefanie S Wittenberg
(74) *Attorney, Agent, or Firm* — John C. Pokotylo; Pokotylo Patent Services

(57) ABSTRACT

Metal components that require anodic coating or anodizing, may also require some surfaces of the component to be free of the anodic coating for the purpose of conductivity. The presence of the anodic coating on surfaces of the component that require conductivity would make those surface more electrically resistant or nonconductive. A combination of a gas pocket or air bubble to create a barrier to anodizing in a cavities of a workpiece (or in a cavity created by a conformal compression material) and the use of a (e.g., compressible) mask/seal material to mask off other surfaces though a gasket sealing function, is used. The mask/seal material may be compressed and makes a seal of some surfaces using pressure from clamping or pressure mechanisms. At least two opposing surfaces are masked by the compressive mask/seal material on one end and a gas pocket on the other end. The gas pocket will allow the anode to make firm electrical contact with the workpiece. The unmasked surfaces of the workpiece will be contacted by the electrolyte and consequently anodized. These anodized surfaces will have more electrical resistance (e.g., have higher resistance, and might even be non-conductive) than the masked surfaces that were not anodized. Further, the selectively anodized surfaces can be colored, seal, or have other conventional post anodizing processes applied.

18 Claims, 9 Drawing Sheets

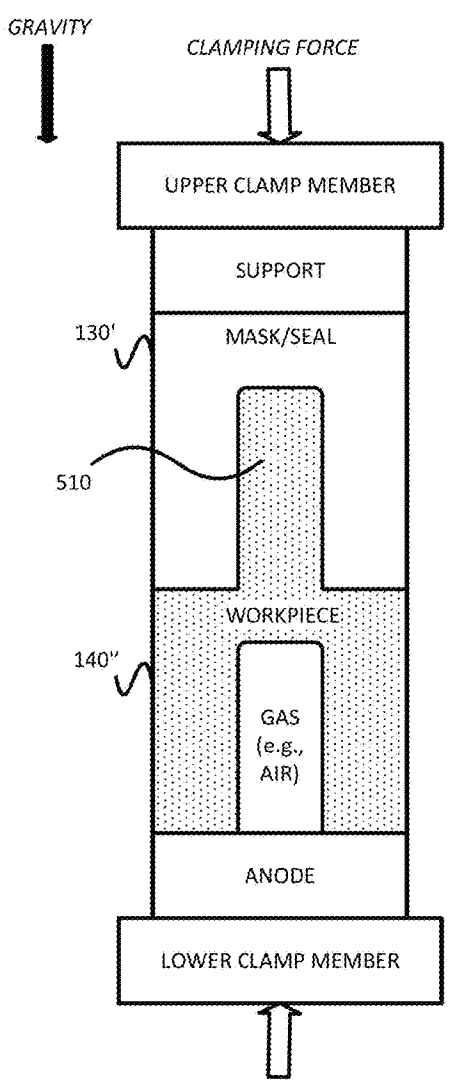
500 FIGURE 5
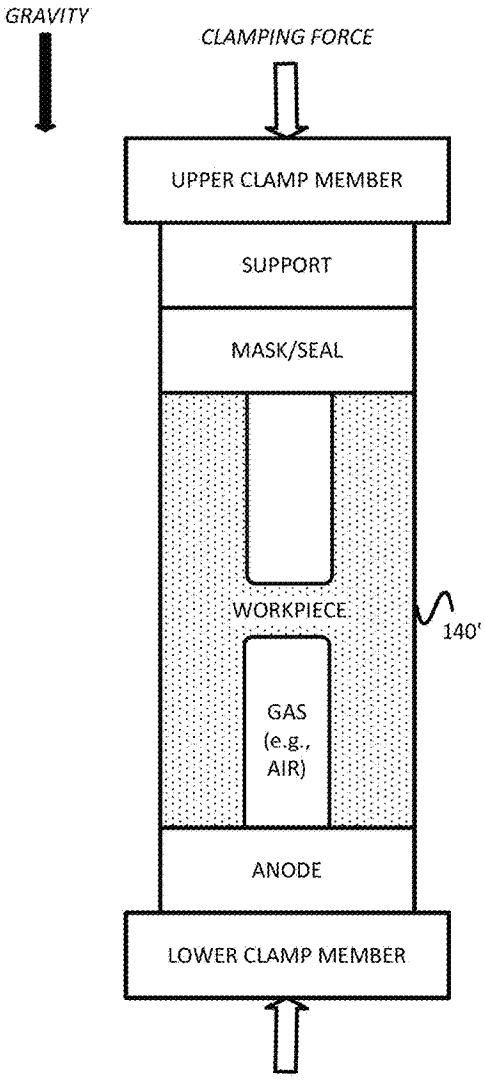
400 FIGURE 4

140'''

140''

800

ASSEMBLIES AND METHODS FOR ANODIZING A WORKPIECE SELECTIVELY USING A COMBINATION OF A MECHANICAL MASK AND A GAS BUBBLE OR AIR POCKET MASK

§ 1. BACKGROUND OF THE INVENTION

§ 1.1 Field of the Invention

The present invention concerns working the surface of a workpiece, such as by using anodizing. Anodizing aluminum is an widely used process.

§ 1.2 Background Information

"Anodizing" is an electrochemical process that converts the metal surface of a workpiece into a durable, corrosion-resistant, anodic oxide finish. Aluminum is the most common metal to be anodized. However, other nonferrous metals, such as magnesium and titanium for example, can also be anodized.

In the case of aluminum, the anodic oxide structure originates from the aluminum substrate and is composed entirely of aluminum oxide. This aluminum oxide is not applied to the surface like paint or plating. Rather, it is fully integrated with the underlying aluminum substrate, so it cannot chip or peel. Further, it has a highly ordered, porous structure that allows for secondary processes such as coloring and sealing.

In the case of aluminum, anodizing is accomplished by immersing the aluminum (which may have been subjected to bead blasting, racking, chemical cleaning and etching, desmutting, and rinsing) into an acid electrolyte bath and passing an electric current through the medium. A cathode is mounted to the inside of the anodizing tank. The aluminum workpiece acts as an anode. As a result, oxygen ions are released from the electrolyte to combine with the aluminum atoms at the surface of the part being anodized. Therefore, anodizing can be thought of as a highly controlled oxidation process which is faster and more controlled than naturally occurring oxidation.

As noted above, the aluminum oxide at the surface of the anodized aluminum workpiece is fully integrated with the underlying aluminum substrate, so it cannot chip or peel, and has a highly ordered, porous structure that allows for secondary processes such as coloring and sealing. Further, the aluminum oxide at the surface has dielectric properties that prevent or resist electrical conductivity, at least relative to any aluminum not subject to anodizing. Consequently, in some cases, metal (such as aluminum) parts need to have one or more surface areas masked off so that the base material is exposed for electrical contact. There may be other reasons to selectively anodize certain surface areas of a metal workpiece, but not other surface areas. By their nature, standard anodized coatings are dielectric coatings that prevent or resisting electrical conductivity.

Presently, in order to selectively mask an aluminum workpiece, a plastic or non-conducting (e.g., dielectric) cap, plating tape, stop off lacquer, or wax may be applied before anodizing, and then removed after anodizing. Unfortunately, these conventional masking processes are labor intensive and do not scale well.

In view of the foregoing, it would be useful to selectively mask off two or more areas of a (e.g., nonferrous) metal workpiece in a less labor intensive way, while anodizing unmasked areas of the metal workpiece.

§ 2. SUMMARY OF THE INVENTION

An example combination for use in anodizing a metal workpiece solves the challenge of selectively masking off two or more areas of a (e.g., nonferrous) metal workpiece while anodizing unmasked areas of the metal workpiece by providing a combination comprising: (a) an upper support member; (b) a mechanical mask provided between the upper support member and the metal workpiece to block electrolyte from at least one surface area of the metal workpiece; (c) the workpiece having a cavity; (d) a gas trapped in at least a part of the cavity in the workpiece and blocking electrolyte from at least one surface area of the cavity; (e) an anode contacting at least a part of the workpiece; and (f) a lower support member supporting at least a portion of the anode.

In some example implementations of the combination, the workpiece is a nonferrous metal. For example, the workpiece may be aluminum, magnesium, titanium, etc.

Some example implementations of the combination further comprise a clamping mechanism providing a force urging the upper support member towards the lower support member.

In some example implementations of the combination, the anode covers an opening of the cavity in the workpiece. In some example implementations of the combination the anode covers an opening of the cavity in the workpiece without making a fluid-tight seal.

In some example implementations of the combination, the mechanical mask is compressible. In such implementations, the combination may further include a clamping mechanism (1) providing a force urging the upper support member towards the lower support member and (2) compressing the mechanical mask (e.g., between the upper support member and the workpiece).

An example anodizing process solves the challenge of selectively masking off two or more areas of a (e.g., nonferrous) metal workpiece while anodizing unmasked areas of the metal workpiece by (a) clamping a metal workpiece between (1) a mechanical mask provided to block electrolyte from at least one surface area of the metal workpiece, and (2) an anode contacting at least a part of the metal workpiece, wherein the metal workpiece has a cavity; (b) lowering the metal workpiece into an reservoir of electrolyte, having at least one cathode, in an orientation such that gas trapped in at least a part of the cavity in the metal workpiece will block the electrolyte from at least one surface area of the cavity; and (c) anodizing the metal workpiece to generate a selectively anodized workpiece. The selectively anodized workpiece resulting may then be removed from the reservoir of electrolyte. The selectively anodized metal workpiece may then be unclamped and removed from between the mechanical mask and the anode.

In some implementations of the example process, the anode covers an opening of the cavity in the workpiece without making a fluid-tight seal.

§ 3. BRIEF DESCRIPTION OF THE DRAWINGS

FIG. 4 illustrates an alternative example assembly having a work piece with two cavities; one up and one down.

FIG. 5 illustrates an alternative example assembly having a work piece with a bottom cavity and a protruding part on top (like a bayonet connector contact).

§ 4. DETAILED DESCRIPTION

A metal workpiece is anodized selectively using a combination of (1) a mechanical mask for at least one target exterior surface of the workpiece and (2) a bubble or gas pocket to mask off at least one other target interior surface of the workpiece. The term "mask" or "mask off" means to prevent masked surfaces of a workpiece from being anodized, while other, unmasked portions of the workpiece surface are anodized.

The term "anodizing" as used in the present application includes hard coat anodizing, soft coat anodizing, or other anodic coating on materials that can be anodized such as nonferrous metals, aluminum, titanium, etc. The purpose of the masking is to leave the masked surfaces free of non-conductive or less conductive anodizing while leaving the unmasked surfaces the subject part base material exposed so that they can be anodized. The unmasked surface can be anodized for corrosion protection, later coloring, and/or for providing dielectric properties of preventing or resisting electrical conductivity.

The direction of gravity is shown in some of the drawings.

The processes described may be performed at normal atmospheric pressure, or may be performed at controlled pressure greater than or less than normal atmospheric pressure.

§ 4.1 Example Assemblies

Figure 2:
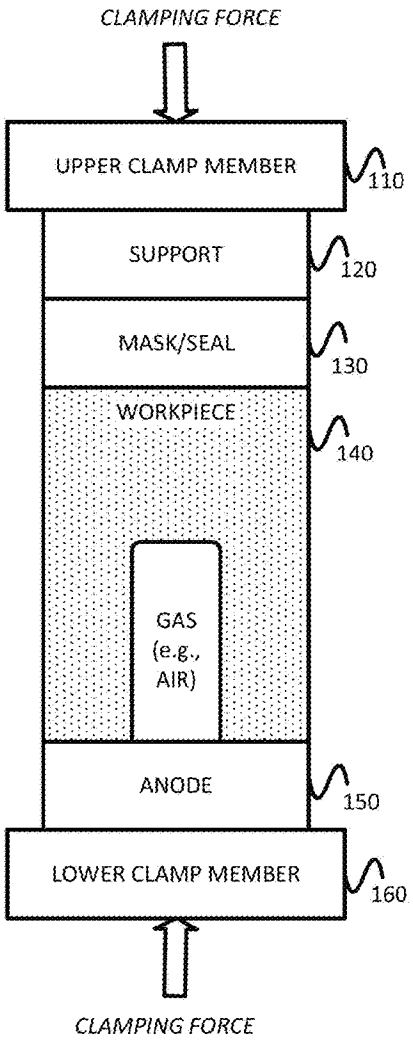
Figure 1:
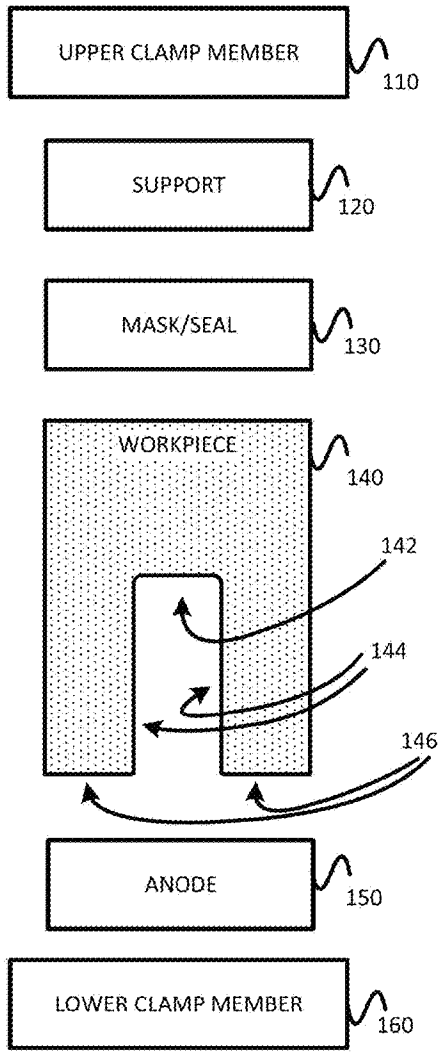
FIG. 1 illustrates an exploded view of, and FIG. 2 illustrates, an example assembly having a workpiece with a top surface masked off and a masked cavity facing down.

FIG. 1 illustrates an exploded view of, and FIG. 2 illustrates, an example assembly having a workpiece with a top surface masked off and a masked cavity facing down. As shown in the exploded view of FIG. 1 and the assembled view of FIG. 2, the example assembly 200 may include, for example, a upper clamp member 110, a support 120, a mask/seal 130, a workpiece 140, an anode 150 and a lower clamp member 160. Referring to FIG. 1, in this example, the workpiece includes a lower cavity (sectioned in the Figure, but closed to form a cavity). The cavity may be any shape, including, but not limited to cylindrical, conical, semi-spherical, cube, triangular prism, rectangular prism, pyramidal, irregular volume, or any combination having any volume. The cavity is generally open at the bottom, but closed at the top and sides. Therefore, the present inventor intends the term "cavity" to include any volume that can trap or hold gas (such as air) when the workpiece is submerged in a liquid or higher density gas. The lower cavity defines an interior surface including a upper cavity surface 142 (which might be considered the bottom of the cavity) and a cavity wall 144 surface.

Referring to FIG. 2, the upper and lower clamp members 110 and 160, collectively or individually apply a clamping force holding the assembly 200 together. Referring to both FIGS. 1 and 2, when assembled, the anode 150 contacts the lower surface(s) 146 of the workpiece 140. This permits electricity to be conducted between the anode 150 and the workpiece 140.

Figure 3:
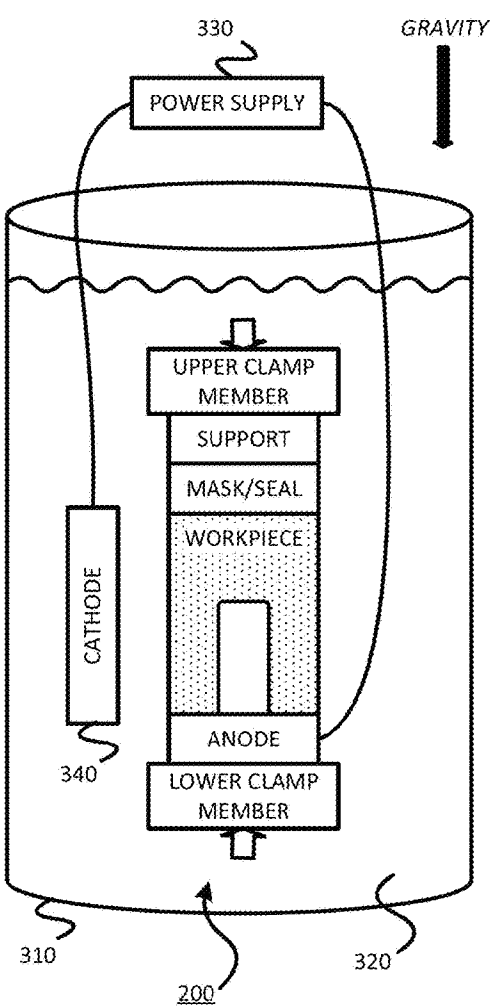
FIG. 3 illustrates the example assembly of FIG. 2 provided in an anodizing tank and electrically connected with a power supply.

FIG. 3 illustrates the example assembly 200 of FIG. 2 provided in an anodizing tank 310 and electrically connected with a power supply 330. As shown, the anodizing tank 310 holds an electrolyte 320, such as sulfuric acid for example. The power supply 330 has a negative terminal electrically connected with at least one cathode 340 in the anodizing tank 310, and a positive terminal electrically connected with the anode 150 of the assembly 200. Although not shown, the assembly 200 can be mechanically attached to a rack used to submerge and remove it from the anodizing tank 310 (also referred to as "dipping"). Note that the top surface of the workpiece 140 will not be anodized due to the mask/seal 130. The mask/seal 130 may form a mechanical barrier to the electrolyte 320 in the anodizing tank 310. Note also that the cavity of the workpiece 140 will not be anodized due a gas (such as air for example) being trapped in the cavity. This gas forms a barrier to the electrolyte 320 in the anodizing tank. (However, it is possible that some electrolyte may contact some side wall surfaces of the cavity adjacent to the anode (for example, due to gas compression).) In this example, it is important to orient the assembly 200 (and workpiece 140) as shown when it is lowered into the electrolyte 320, so that the gas (e.g., air) is held in the cavity of the workpiece. Finally, portions of the workpiece 140 surface touching the anode 150 may have less exposure to the electrolyte 320 than the side surfaces of the workpiece 140, but the workpiece-anode contact point(s) are not intended to form a strong fluid-tight seal (such as that formed by the mask seal 130).

The amount of anodizing (amount of oxidation) to be applied to the unmasked surfaces of the workpiece 140 will be application specific. Anodizing parameters such as electrolyte type, electrolyte strength, time, electrolyte temperature, voltage, preprocessing, etc., can be adjusted in known or proprietary ways to achieve the desired amount of anodizing.

§ 4.2 Refinements, Alternatives, and/or Extensions

Referring back to 110 and 160 of FIGS. 1 and 2, the upper and lower clamp members may be anything that serve to hold the mask/seal 130, workpiece 140, and anode 150 in the desired configuration. Examples include members urged together by a spring force, members urged together by tightened threaded bolts and nuts (See, for example, FIGS. 8 and 9A-9C, described below.), members urged together by gravity, members urged together by any force, or any combination of the foregoing. Although the upper and lower clamp members should be resistant to degradation by the electrolyte, this is not strictly necessary. However, the clamping function should be designed to be able to survive the electrolyte and survive the anodizing process. The upper clamp member 110 and/or lower clamp member 160 may also function as a support, in which case one or more separate support members (e.g., 120) are not necessary.

Referring back to 130 of FIGS. 1 and 2 mask/seal examples provide a mechanical barrier preventing or adequately limiting electrolyte from the masked surface. For example, the mask/seal may be a compressible material such solid or foam rubber, silicon, the polytetrafluoroethylene (PTFE) family of materials, etc. The mask/seal is preferably a compressible material, although this is not strictly necessary. The mask/seal may be reusable. Alternatively, the mask/seal may be applied (e.g., sprayed on, brushed on, etc.) to the workpiece before anodizing and then removed from the workpiece after anodizing, but such an alternative mask/seal might suffer from problems (e.g., labor intensiveness) of conventional masking. Therefore, it would be advantageous to avoid such an alternative mask/seal, especially on the upper surface of the workpiece 140 when held in the assembly 200. However, there may be applications in which other portions of the workpiece are to be masked, and various techniques may be used.

FIG. 4 illustrates an alternative example assembly 400. This is the same as the assembly 200 of FIG. 2, except the workpiece 140' in FIG. 4 has two cavities; one open on the top (opposite gravity) and one on the bottom.

FIG. 5 illustrates an alternative example assembly 500. This is the same as the assembly 200 of FIG. 2, except the workpiece 140" in FIG. 5 has a protruding part on top (like a bayonet connector contact), and a mask/seal 130' that conforms to the protruding part on the top, thereby masking this portion from the electrolyte when immersed in the anodizing tank.

Figure 7:
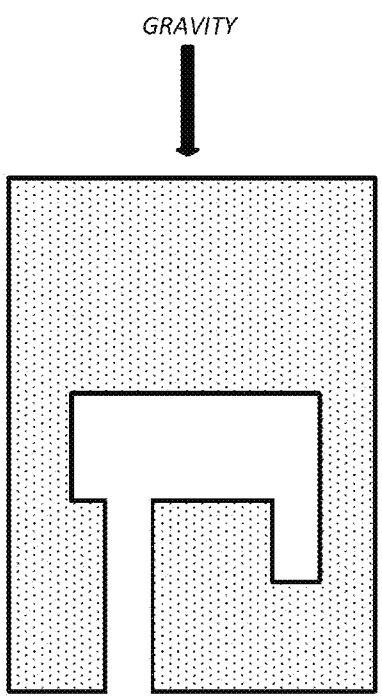
FIGS. 6 and 7 are cross sections of different workpiece cavities for illustrating how gas (e.g., air) can be trapped in only a part of a cavity.
Figure 6:
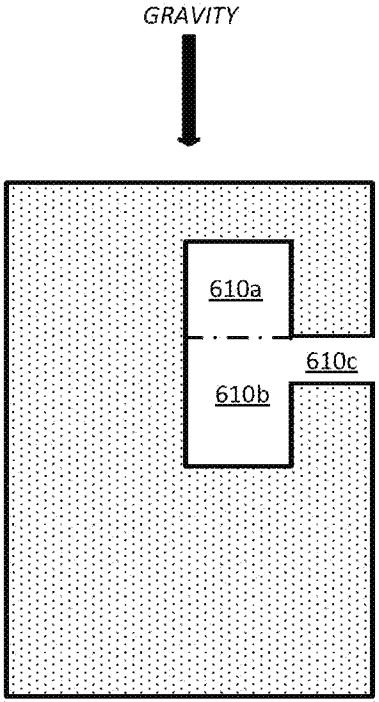

Referring back to 140 of FIGS. 1 and 2, as well as 140' of FIGS. 4 and 140" of FIG. 5, the workpiece may be made of any material that can be anodized, such as for example, nonferrous metals such as aluminum, magnesium, titanium, etc. In embodiments consistent with the present description, the workpiece includes a cavity (cross-section illustrated in the Figures) that (1) is to be masked from the electrolyte (and therefore from anodizing), and (2) that can hold a gas when dipped into the electrolyte, wherein the gas prevents the electrolyte from contacting a surface or surfaces intended to be masked. For example, FIG. 6 illustrates a cross-section of a workpiece 140''' having a cavity 610 (including upper interior part 610*a*, lower interior part 620*b*, and channel 610*c*. In this example, only the surfaces of upper interior part 610*a* (above dot-dash line) will be masked by gas (assuming gas in the lower interior part 610*b* and channel 620*c* can escape and be replaced by the electrolyte). On the other hand, FIG. 7 illustrates a cross-section of a workpiece 140'''' in which all surfaces of cavity 710 will be masked by trapped gas.

As noted above, the cavity may be any volume, including, but not limited to, cylindrical, conical, semi-spherical, cube, triangular prism, rectangular prism, pyramidal, irregular volume, or any combination or regular and/or irregular volumes. The cavity is generally open at the bottom, but closed at the top and sides. Therefore, the present inventor intends the term "cavity" to include any volume that can trap or hold gas (such as air) when the workpiece is submerged in a liquid or higher density gas.

The gas "pocket" held in at least a portion of cavity can be air, gas from the anodize process (e.g., from the electrolysis of water), a gas intentionally introduced into the cavity, or any combination of the foregoing.

Figure 8:
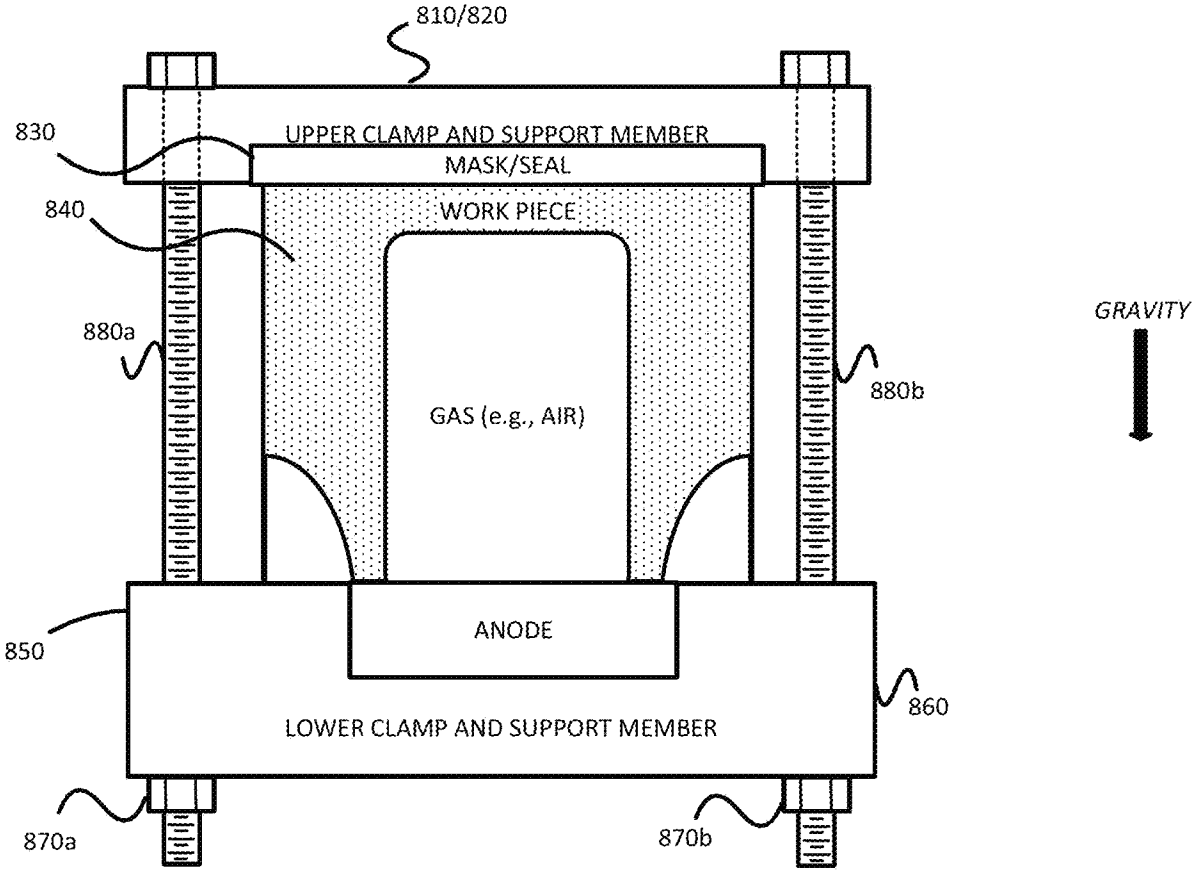
FIG. 8 illustrates an example assembly having a work piece with a top surface masked off and a masked cavity facing down, in which an upper clamp and support portion and a lower clamp and support portion are held to one another, and hold other parts of the assembly, via a threaded nuts and bolts.

FIG. 8 illustrates an example assembly 800 having a work piece 840 with a top surface masked off and a masked cavity facing down, in which an upper clamp and support portion 810/820 and a lower clamp and support portion 860 are held to one another, and hold other parts of the assembly (for example, the mask/seal 830), via a threaded nuts 870*a* and 870*b* and bolts 880*a* and 880*b*.

Figure 9A:
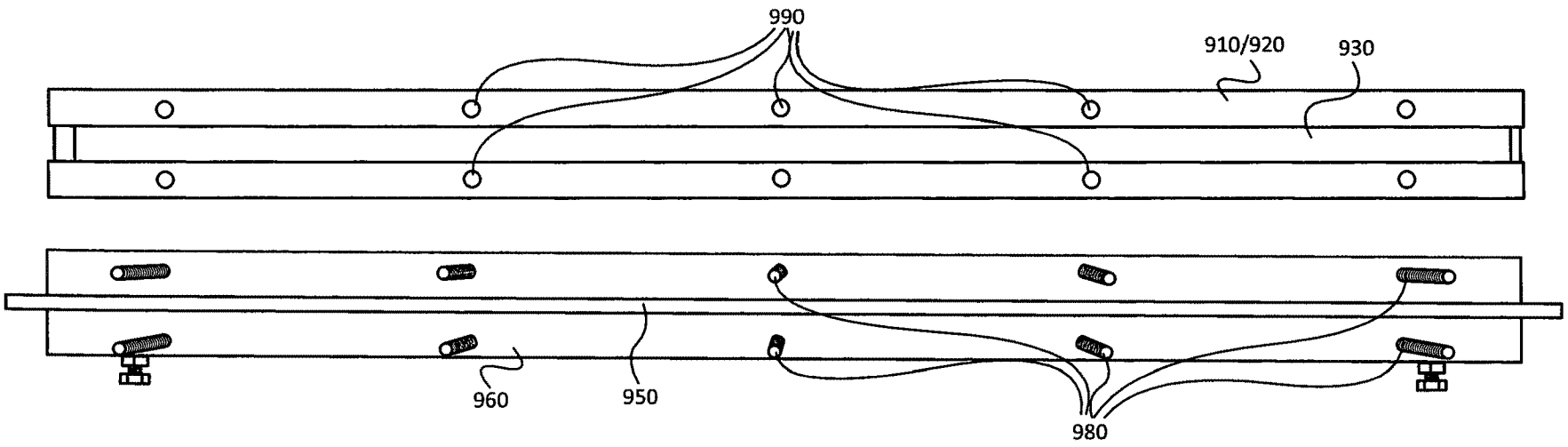
FIG. 9A is a top plan view photograph and 9B is a top perspective view photograph, each illustrating an example implementation of the example assembly of FIG. 8 (without workpieces).
Figure 9B:
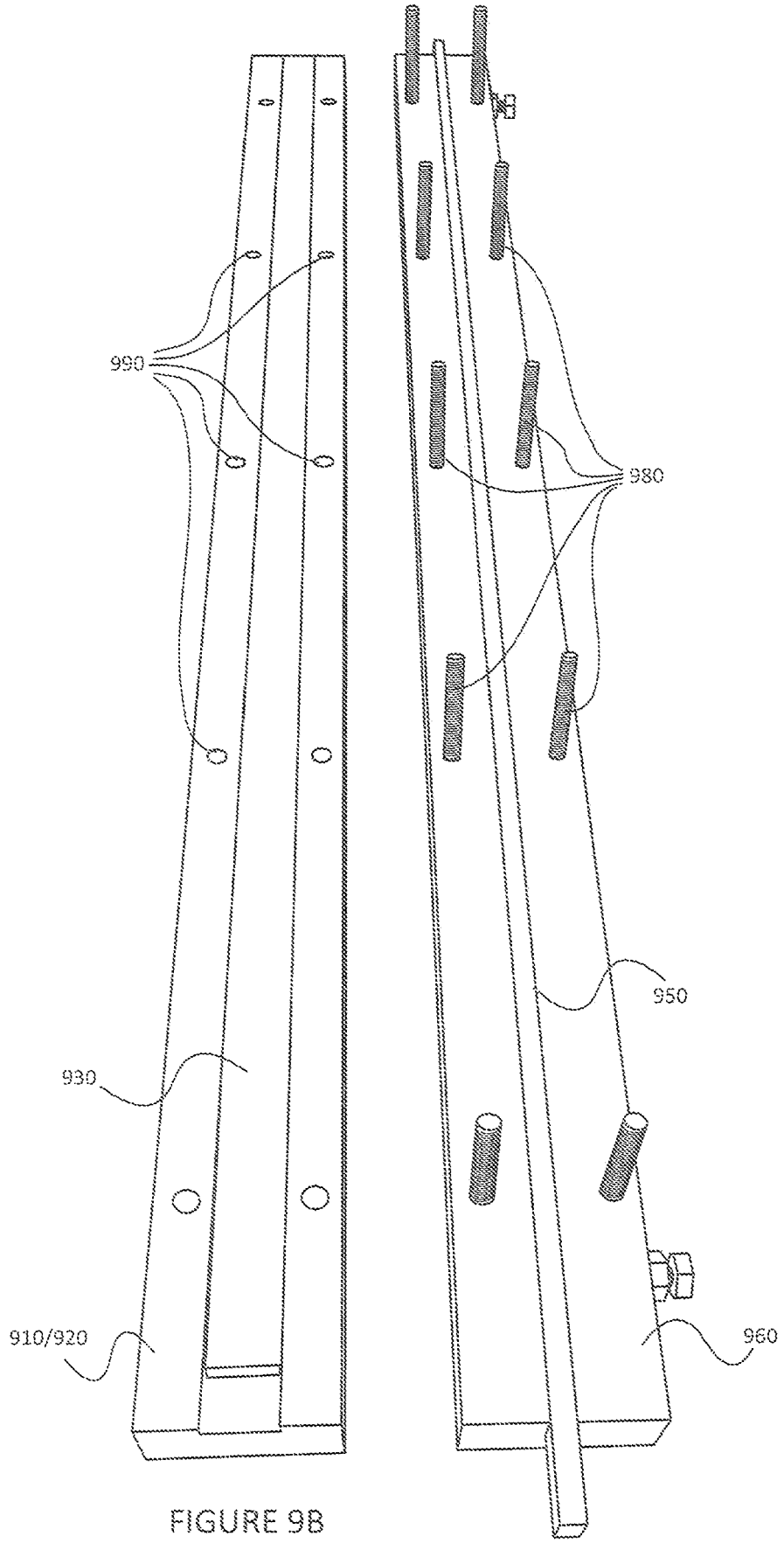
FIG. 9C is a perspective view photograph of the example assembly of FIGS. 9A and 9B, clamping workpieces.
Figure 9C:
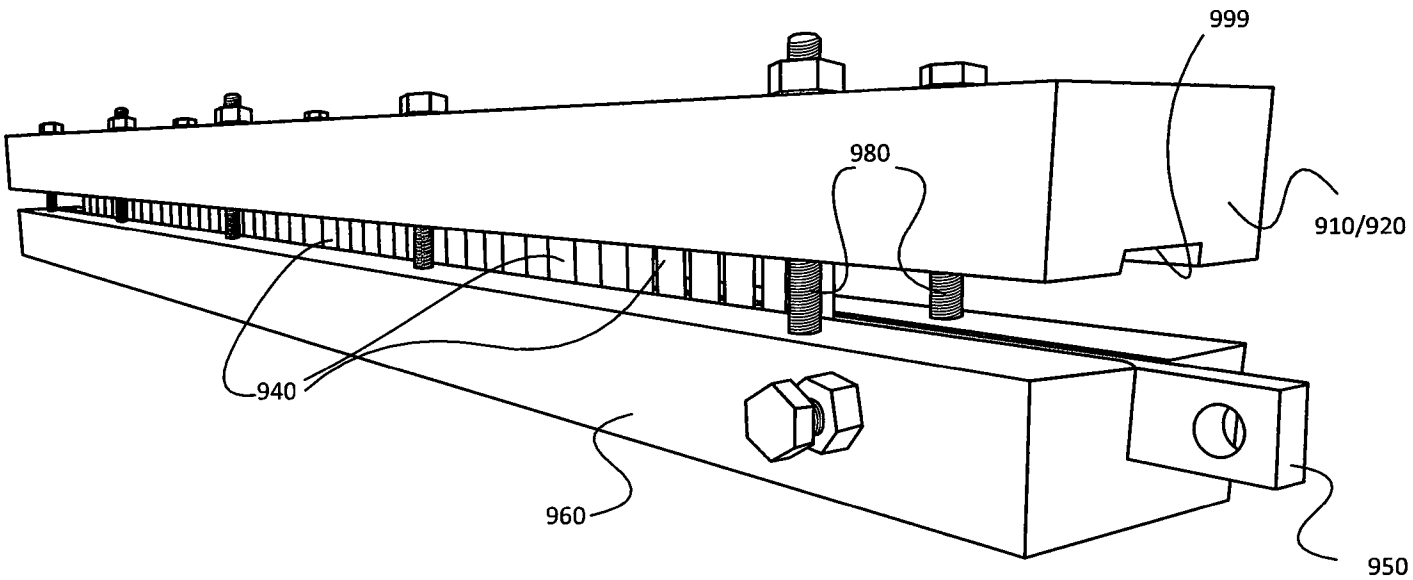

FIGS. 9A and 9B are photographs of an implementation of parts of an assembly consistent with that 800 of FIG. 8, configured to accommodate a row of workpieces (not shown). The photographs of FIGS. 9A and 9B show the underside of a plastic (e.g., polyethylene) upper clamp member and support 910/920 having a shallow channel cutout to receive a foam mask/seal 930, as well as holes 990 through which bolts (Recall 880*a* and 880*b* of FIG. 8.) may pass. A row of workpieces (not shown) may be arranged upside-down on the foam mask/seal 930. These Figures also show a titanium bar 950, used as an anode, provided in a shallow channel cutout in a plastic (e.g., polyethylene) lower clamp member and support 960. Bolts 980 pass through holes in the lower clamp member and support 960. The bolts 980 in FIGS. 9A and 9B can pass through the holes 990 in the upper clamp member and support 910/920 and be tightened. As was the case in FIG. 8, in the resulting assembly, a top area of each of the workpieces (not shown) is masked by the foam mask/seal 930, the bottom of each of the workpieces (not shown) contacts the titanium anode 950, whereby a cavity in the bottom of the workpieces holds a pocket of air when the assembly is dipped into an electrolyte. FIG. 9C is a perspective view photograph of the example assembly of FIGS. 9A and 9B, clamping workpieces 940. Note that although the mask/seal 930 is not shown in FIG. 9C, it is accommodated in a channel 999 in the upper clamp member and support 910/920.

Figure 10:
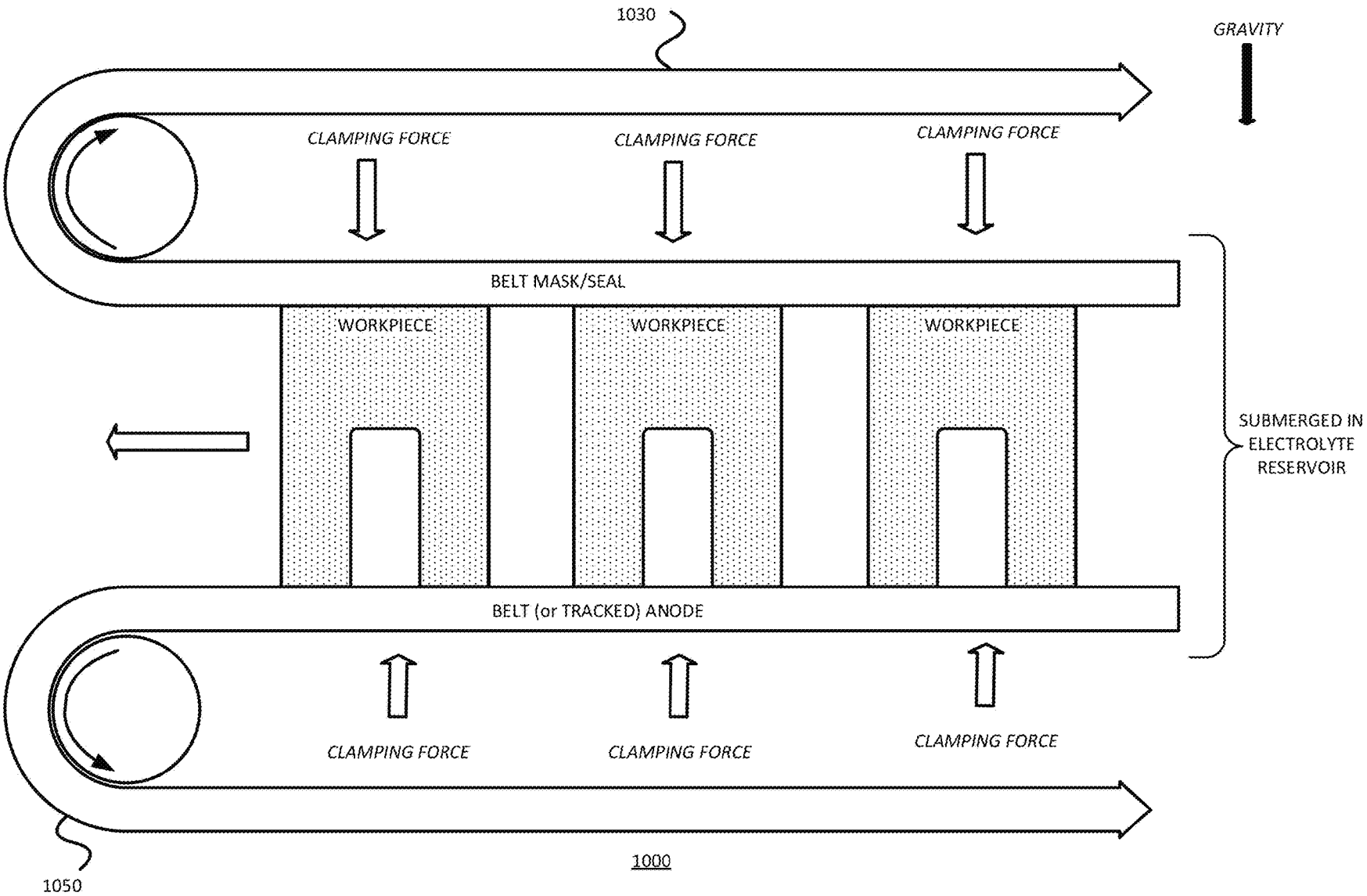
FIG. 10 illustrates a continuous conveyed anodizing process consistent with the present description.

FIG. 10 illustrates a continuous, conveyed, anodizing process consistent with the present description. Workpieces are held between a belt mask/seal 1030 on their tops and a belt or tracked anode 1050 on their bottoms, and move from right to left. Clamping forces are distributed along the belt mask/seal 1030 and/or along the belt or tracked anode 1050. The workpieces are submerged in an electrolyte (now shown) and a cathode (not shown) is provided in the electrolyte. A voltage is applied across the cathode and belt or tracked anode. If a tracked anode is used, one example would be rectangular plates which may pivot with respect to one another via hinges.

§ 4.3 Example Processes

Figure 11:
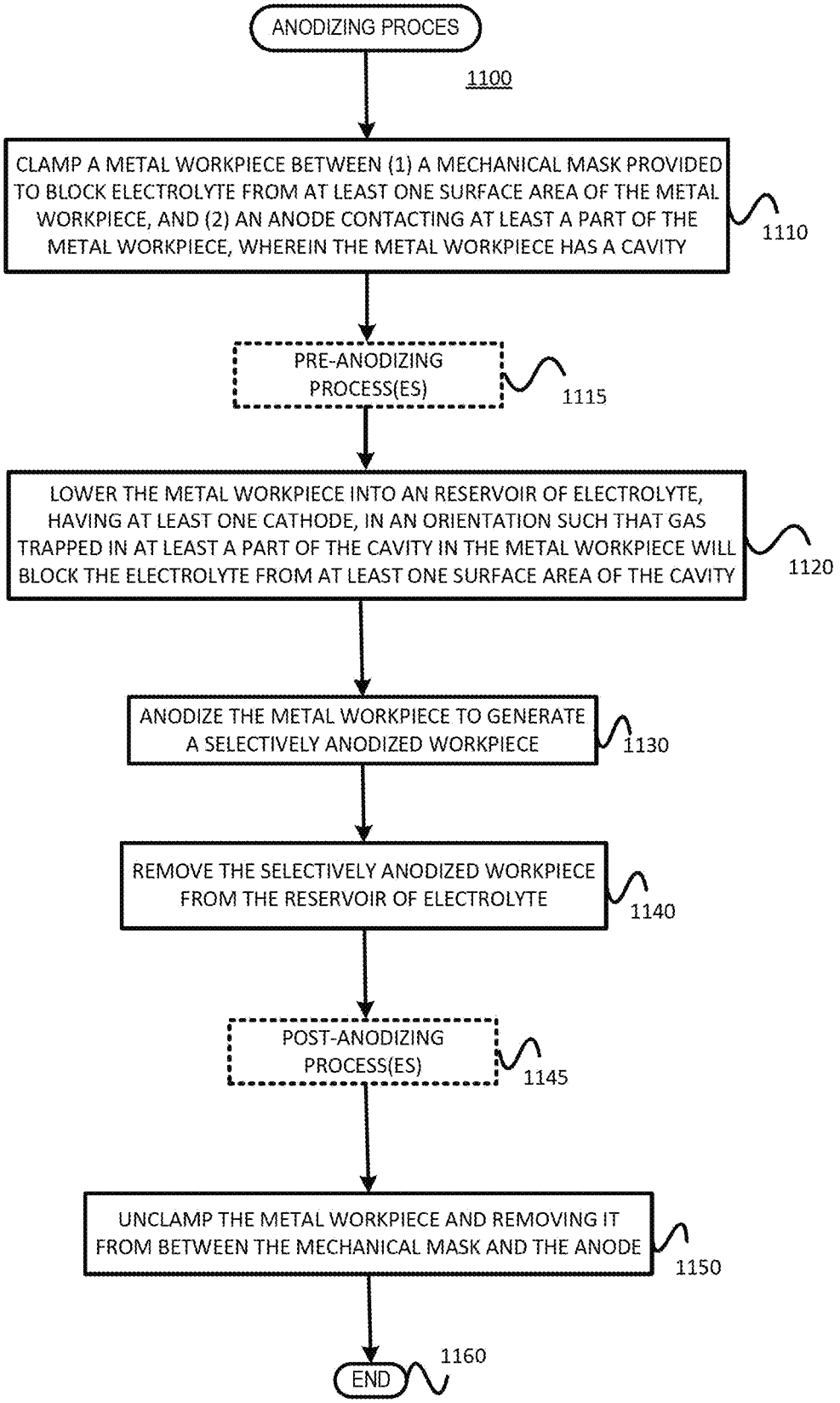
FIG. 11 is a flow chart of an example anodizing process consistent with the present description.

FIG. 11 is a flow chart of an example anodizing process 1100 consistent with the present description. Dashed lines are used to show optional (e.g., conventional) steps 1115 and 1145 to the process 1100. First, a metal workpiece, having a cavity, is clamped between (1) a mechanical mask provided to block electrolyte from at least one surface area of the metal workpiece, and (2) an anode contacting at least a part of the metal workpiece. (Block 1110) Certain (e.g., conventional) pre-anodizing steps (such as cleaning, etching, desmutting, etc.) may be performed. (Block 1115) Depending on the application for the workpieces, some of these steps may be necessary, and some of these steps may be optional. The metal workpiece is then lowered into an reservoir of electrolyte, having at least one cathode, in an orientation such that gas trapped in at least a part of the cavity in the metal workpiece will block the electrolyte from at least one surface area of the cavity. (Block 1120) Then, the metal workpiece is anodized to generate a selectively anodized workpiece. (Block 1130) The selectively anodized workpiece is then removed from the reservoir of electrolyte. (Block 1140) Certain (e.g., conventional) post-anodizing steps (such as coloring, sealing, etc.) may be performed. (Block 1145) Depending on the application for the workpieces, some of these steps may be necessary, and some of these steps may be optional. Finally, the metal workpiece is unclamped and removed from between the mechanical mask and the anode (Block 1150) and the example method 1100 is left (Node 1160).

Referring back to block 1110, in at least some example implementations of the process 1100 of FIG. 11, the anode covers an opening of the cavity in the workpiece. However, this is not necessary.

§ 4.4 Conclusions

As can be appreciated from the foregoing, a bubble or gas pocket is created when a cavity in a workpiece is facing down during racking so the cavity traps air. The gas pocket inside the cavity might have additional gases added by way electrolysis of process solution during the anodizing process. This might occur because the contact to the anode bar set below the cavity is likely not watertight.

The interior of a workpiece facing down will have an air or gas pocket and will not anodize if the gas cannot escape. However, consistent with the present description, two or more surfaces are masked using the gas bubble in combination with the mechanical mask/seal (e.g., made of compressible materials). If a compressible mask/seal is used, its shape memory will exert a force on the workpiece to make a positive contact to the anode. Anodic coatings standardly require a positive electrical contact to an anode due to the higher voltages and amperages used in the process. This positive contact unlike a lot of electroplating electrical contacts cannot be loose such as just hanging on a hook or tumbling in a barrel. This is because loose electrical contacts to the subject part in the anodizing process can cause electrical arcing and damage the base material of the subject metal part as well as an inferior anodic coating. A compressible mask/seal material keeps the workpiece's positive contact to the anode while also preventing anodizing of the surfaces it masks. Although there may be some electrolyte intrusion into a cavity, and consequent anodic intrusion into a portion of a cavity, the gas pocket keeps the majority of the interior surface of the cavity (and especially the inner surface of the cavity away from the anode) free of the anodic coating, and can keep the entire end of the cavity free of anodic coating. The protected interior surfaces will remain conductive. The gas pocket or bubble in this method is intentional due to subject metal workpiece orientation.

Even if the bubble or gas pocket does not protect the entire cavity because of process solution intrusion, in many applications, it will protect enough of the side walls and the very bottom of the cavity (in the case of workpieces 140 of FIGS. 1 and 2, 140' of FIG. 4, 140" of FIG. 5, 840 of FIG. 8, and those in FIG. 10. Note that the bottom of the cavity will be at the top when dipped into the electrolyte for anodizing), yet will allow the anode to make good conductive electrical contact with an area on the workpiece for purposes of anodizing.

At least some embodiments consistent with the present description advantageously improve the productivity, efficiency, feasibility and scalability of masking off target surfaces during the anodizing process, selectively preventing anodic coating from target surfaces and selectively anodize coating other target surfaces.

At least some embodiments consistent with the present description advantageously provide mechanisms and methods to selectively mask off target surfaces of a metal parts, leaving targeted masked uncoated surfaces electrically conductive.

At least some embodiments consistent with the present description advantageously provide mechanisms and methods to selectively anodize targeted surfaces making them electrically non-conductive or less conductive.

At least some embodiments consistent with the present description advantageously mask off two or more surfaces of a metal part from being anodized. At least one surface is masked off using compressible materials capable of sealing a surface from the anodizing process chemical solution (electrolyte) and the electrical current used to create the anodic coating. This mechanical mask mechanism combined with the use of a bubble to block the anodizing of interior cavities advantageously creates at least two masked or non-anodized surfaces and anodized coating of the exposed surfaces resulting in non-conductive or less conductive exposed surfaces.

At least some embodiments consistent with the present description advantageously mask a metal part using a mechanical mask made of a compressible material such solid or foam rubber like materials, PTFE like materials, silicon like materials which are compressed using a clamping mechanism to create a mechanical seal on at least one surface of a metal part. The compression may serve two functions. The first function is to create a seal sealing gasket like on the surface that the mechanical mask is compressed against. The second function is to compress the subject metal part against the anodic electrical contact making a positive and continuous electrical contact throughout the anodizing process.

At least some embodiments consistent with the present description advantageously selectively anodize exposed metal surfaces and selectively mask off at least two surfaces using mechanic mask made a soft compressive material, a clamping mechanism, an anode to make electrical contact, and an air or gas pocket(s) that created by downward facing cavities due to metal workpiece orientation or gas pockets that occurs under a conformal mechanical mask.

At least some embodiments consistent with the present description advantageously provide mechanisms that are scalable to high production in a rack plating process. In a rack anodizing process, the mask tooling mechanism is mounted on to an electrically conductive rack holder or is an integral part of an electrically conductive anodizing rack. The rack anodizing method may process many workpieces being masked by the selective masking mechanism. The masking mechanism may be separated from the mask mechanism holder rack to allow for more efficient racking of subject workpieces to the masking mechanism or automated racking of subject parts to the masking mechanism. The masking assembly mechanism can be transferred to the rack holder (which may also be referred to as a "frame") that is electrically conductive and makes a positive connection back to a power source. The masking mechanism has an anode bar or plate that can be fastened to the mechanism holder rack with the use of conductive clips or fasteners. The mechanism holder rack can hold many masking mechanisms which increases the number of workpieces in a production load which increases production quantity capabilities.

At least some embodiments consistent with the present description advantageously provide mechanisms capable of being used in continuous anodizing operation. In the continuous process, the mechanical compressive mask may be a loop, belt, track, and/or reel-to-reel compressed by supportive structure that applies pressure to the compressive material pressing the workpiece(s) against a specifically designed linked chain, which serves as the electrically conductive anode. The cavities will be facing down to trap the gas bubble and the top surface is at least partially masked by the sealing compressive mask. The workpieces move through the anodizing process tanks continuously held between the compressive material and the and chain. Alternatively, the parts can pass through the process solutions under the surface process solution using a belt seal and a belt or tracked anode passing through small holes in the sides of the process tank, or that are otherwise guided into and out of the tank. If the process tank has holes, the holes are sized to allow mechanisms and parts to pass through the process solution while minimizes the outflow of the solution which overflows between process tanks to capture tanks, and then the process solution is returned to the process tank of origin.

What is claimed is:

1. An apparatus for use in anodizing a metal workpiece, the apparatus comprising:

a) an upper support member;

b) a mechanical mask provided between the upper support member and the metal workpiece to block electrolyte from at least one surface area of the metal workpiece;

c) the metal workpiece having a cavity;

d) a gas trapped in at least a part of the cavity in the metal workpiece and blocking electrolyte from at least one surface area of the cavity;

e) an anode contacting at least a part of the metal workpiece;

f) a lower support member supporting at least a portion of the anode;

g) a reservoir of electrolyte including a cathode, wherein the metal workpiece is held in the reservoir of electrolyte in an orientation such that gas trapped in at least a part of the cavity in the metal workpiece will block the electrolyte from at least one surface area of the cavity; and h) a power supply configured to provide a voltage across the cathode and the anode.

2. The apparatus of claim 1, wherein the metal workpiece is a nonferrous metal.

3. The apparatus of claim 1, wherein the metal workpiece is aluminum.

4. The apparatus of claim 1, wherein the metal workpiece is magnesium.

5. The apparatus of claim 1, wherein the metal workpiece is titanium.

6. The apparatus of claim 1 further comprising:

g) a clamping mechanism providing a force urging the upper support member towards the lower support member.

7. The apparatus of claim 1 wherein the mechanical mask is compressible, the apparatus further comprising:

i) a clamping mechanism providing a force urging the upper support member towards the lower support member and compressing the mechanical mask.

8. An apparatus for use in anodizing a metal workpiece, the apparatus comprising:

a) an upper support member;

b) a mechanical mask provided between the upper support member and the metal workpiece to block electrolyte from at least one surface area of the metal workpiece;

c) the metal workpiece having a cavity;

d) a gas trapped in at least a part of the cavity in the metal workpiece and blocking electrolyte from at least one surface area of the cavity;

e) an anode contacting at least a part of the metal workpiece;

f) a lower support member supporting at least a portion of the anode; and g) a reservoir of electrolyte including a cathode, wherein the metal workpiece is held in the reservoir of electrolyte in an orientation such that gas trapped in at least a part of the cavity in the metal workpiece will block the electrolyte from at least one surface area of the cavity, wherein the anode covers an opening of the cavity in the metal workpiece.

9. The apparatus of claim 8 wherein the anode covers the opening of the cavity in the metal workpiece without making a fluid-tight seal.

10. The apparatus of claim 1 wherein the mechanical mask is compressible.

11. An anodizing process comprising:

a) clamping a metal workpiece having a cavity in a holder, the holder including 1) an upper support member, 2) a mechanical mask provided between the upper support member and the metal workpiece to block electrolyte from at least one surface area of the metal workpiece, 3) an anode contacting at least a part of the metal workpiece, and 4) a lower support member supporting at least a portion of the anode;

b) lowering the holder with the metal workpiece clamped into a reservoir of electrolyte, having at least one cathode, in an orientation such that gas trapped in at least a part of the cavity in the metal workpiece will block the electrolyte from at least one surface area of the cavity; and c) anodizing the metal workpiece using a power supply to apply a voltage across the cathode and the anode, to generate a selectively anodized metal workpiece.

12. The anodizing process of claim 11 further comprising:

d) removing the holder clamping the selectively anodized metal workpiece from the reservoir of electrolyte.

13. The anodizing process of claim 12 further comprising:

e) unclamping the selectively anodized metal workpiece from the holder and removing it from between the mechanical mask and the anode.

14. The anodizing process of claim 11, wherein the metal workpiece is a nonferrous metal.

15. The anodizing process of claim 11, wherein the metal workpiece is aluminum.

16. The anodizing process of claim 11, wherein the metal workpiece is magnesium.

17. The anodizing process of claim 11, wherein the metal workpiece is titanium.

18. The anodizing process of claim 11, wherein the anode covers an opening of the cavity in the metal workpiece without creating a fluid-tight seal.

* * * * *